United States Patent [19]

Lipschutz

[11] 4,025,740

[45] May 24, 1977

[54] ANTI-THEFT SAFETY DEVICE FOR AN AUTOMOBILE VEHICLE

[75] Inventor: Paul Lipschutz, Croissy, France

[73] Assignee: Neiman, S.A., Courbevoie, France

[22] Filed: Apr. 9, 1976

[21] Appl. No.: 675,374

[30] Foreign Application Priority Data

May 2, 1975 France ..... 75.13893

[52] U.S. Cl. ..... 200/44; 70/431

[51] Int. Cl.² ..... H01H 27/06

[58] Field of Search ..... 200/42, 44; 70/431, 70/252, 403, 447

[56] References Cited

UNITED STATES PATENTS

| | | | |
|---|---|---|---|
| 913,942 | 3/1909 | Bodge | 70/403 |
| 3,257,517 | 6/1966 | Sedley | 200/44 |

*Primary Examiner*—Thomas J. Kozma

*Attorney, Agent, or Firm*—Nolte and Nolte

[57] ABSTRACT

An anti-theft safety device for an automobile vehicle comprising a lock having a rotatable barrel cooperating with a key which has a cylindrical body and is provided with a driver of non-circular cross-sectional shape which cooperates with a cavity of complementary shape formed in the barrel. Said barrel actuates, in the course of its rotation, means for locking at least one device essential for the operation of the vehicle and means for closing electric circuits. A rotatable electric switch is provided therein which is driven by cooperation of an opening of the switch with a driver, of complementary profile, on the key, the last-mentioned driver having sufficient length to continue to cooperate with said opening when the key has been partially extracted from the barrel and the driver for the barrel no longer drives the barrel.

9 Claims, 6 Drawing Figures

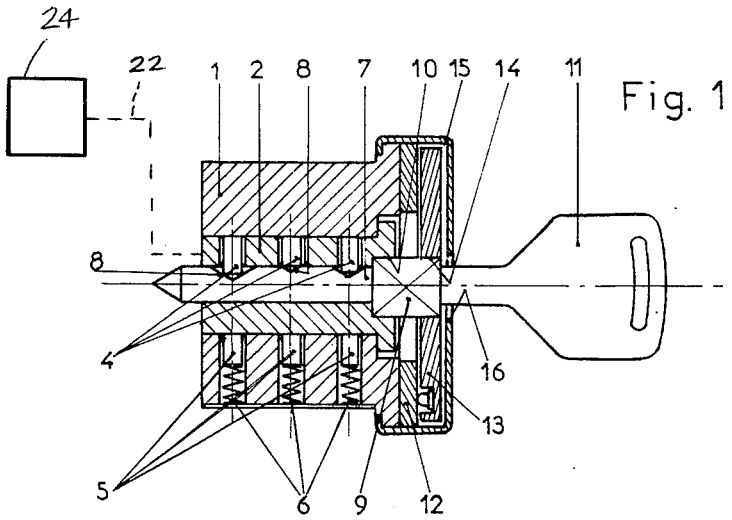
Fig. 1
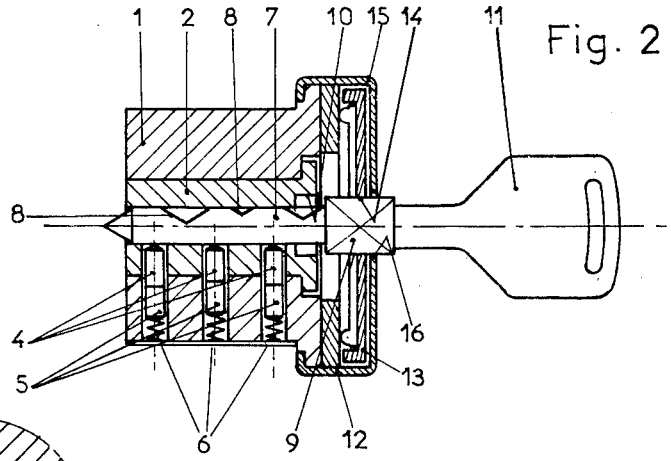
Fig. 2
Fig. 3
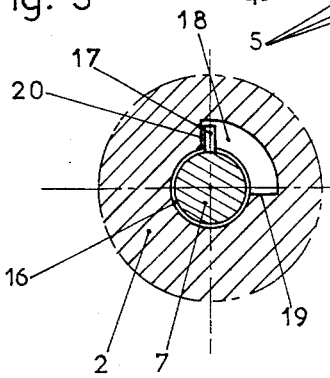
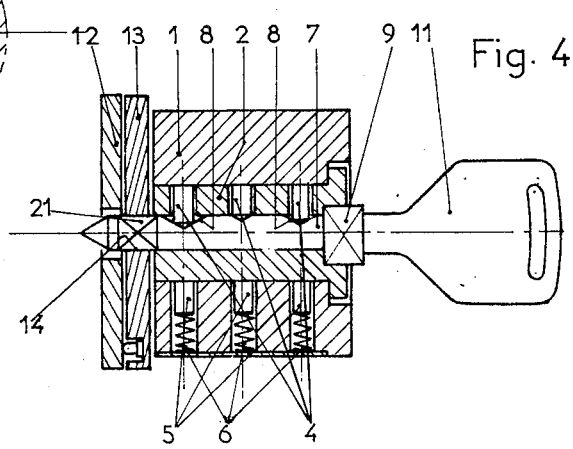
Fig. 4

ANTI-THEFT SAFETY DEVICE FOR AN AUTOMOBILE VEHICLE

The present invention relates to an anti-theft safety device for an automobile vehicle.

For reasons of safety, certain vehicles must have an anti-theft device which mechanically prevents the driving of the vehicle and at the same time cuts off the whole of the electric supply or, on the contrary, leaves operative the supply of certain electric circuits. This is the case in particular of transporters of inflammable materials such as hydrocarbons. When loading ("stop" position), the transporter must be in the anti-theft position, for example with the steering locked and, moreover, prevention of the closure of any electric circuit, including the lighting or signalling circuits, so as to avoid any risk of fire or deflagration. On the other hand, in the normal parking conditions ("parking" position), the transporter must also be in an anti-theft position but he must be able to close certain electric circuits such as the parking lights circuits, the distress signal circuit, the circuits of certain accessories such as the interior lighting, cigarette lighter, radio, etc. In these two distinct positions of the anti-theft device, it must be possible to withdraw the key.

To solve this problem, it is known to employ barrel-type locks comprising two rows of means for receiving locking members, such as plates or pistons, which are angularly offset in the body or stator of the lock so that the key may be extracted when either of these two rows is facing a row of locking members provided in the barrel or rotor of the lock, that is to say, in two distinct angular positions of the barrel.

This solution is very costly, since, in both positions, the mechanical locking members must be actuated together with the safety devices, for example the key-extracting safety device associated therewith. This in practice requires repeating a large number of mechanical members, in addition to the repetion of the locking members of the stator.

Barrel-type locks are, moreover, known which employ a key having a notched cylindrical body and including a driver having a non-circular section which cooperates with a cavity of complementary shape provided in the rotor.

An object of the invention is to improve locks of the latter type so as to permit obtaining, for example, the aforementioned "stop" and "parking" positions with simple, cheap and reliable means.

According to the invention, there is provided an anti-theft safety device for an automobile vehicle comprising a lock having a rotatable barrel cooperating with a key having a cylindrical body provided with a driver of non-circular cross-sectional shape which cooperates with a cavity of complementary shape formed in the barrel, said barrel actuating, in the course of its rotation, means for locking at least one device essential to the operation of the vehicle and means for closing electric circuits, wherein there is provided a rotary electric switch driven by cooperation of an opening in the switch with a driver, of complementary profile, on the key, the last-mentioned driver having sufficient length to continue to cooperate with said opening when the key has been partially extracted from the barrel and the driver for the barrel no longer drives the barrel.

With the anti-theft device according to the invention, the partial extraction of the key in the "stop" position, which is normally the only position in which the key may be extracted, permits a continuation of the rotation of the electric switch, which may be a secondary switch, by rotation of the key to another angular position in which the desired electric circuits are closed, but the mechanical locking of the lock is maintained owing to the fact that the barrel is locked against rotation by the partial extraction of the key, the rotation of the key being however permitted owing to the cylindrical shape of its body.

In one embodiment of the invention, the driver of the electric switch is constituted by an extension of the barrel driver and said switch is disposed between the barrel and the key entrance of the lock.

In a modification, the driver of the switch is disposed in the vicinity of the free end of the key and said switch is located adjacent the end of the barrel opposite to the key entrance of the lock. In the latter case, in a preferred embodiment of the invention, said switch, which is this time the only switch, is part of means for closing electric circuits of the anti-theft device, which permits the use of a single switch which performs all the electric functions of the vehicle and is driven directly by the key.

An understanding of the invention will be had from the ensuing description with reference to the accompanying drawings in which:

FIG. 1 is an axial sectional view of an anti-theft device according to one embodiment of the invention in an angular position which is not the "stop" position;

FIG. 2 is similar to FIG. 1, the anti-theft device being in the "stop" position with the key partially extracted;

FIG. 3 is a cross-sectional view to an enlarged scale of a detail of the anti-theft device of FIGS. 1 and 2 which has not been shown in these Figures;

FIG. 4 is similar to FIG. 1 in respect of a modification;

Figure 6:
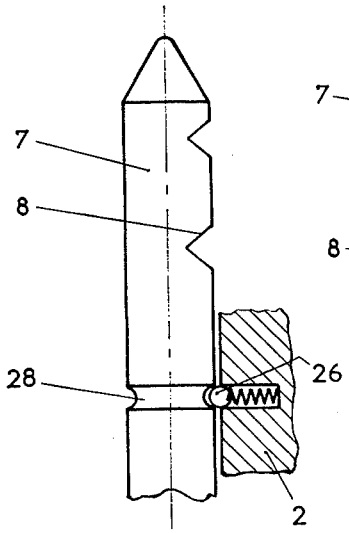
FIG. 6 is a detail of a variation of the structure of FIG. 1.

The lock comprises a body or stator 1 in which there is journalled a cylindrical rotor or barrel 2 provided with an axial cylindrical key passage 3. The rotor has a row of radial bores each provided with a piston 4 and the stator has a corresponding row of radial bores provided with pistions 5 biased by springs 6.

The key for driving the rotor 2 has a cylindrical body 7 provided with notches 8 adapted to cooperate with the ends of the pistons 4 opposed to the rotor. The body 7 of the key is extended by a driver 9 having a non-circular cross-sectional shape and cooperating with a cavity 10 of corresponding shape formed in the rotor 2 at the entrance of the passage 3, this cooperation ensuring a positive driving of the rotor 2. The key terminates in a holding head 11.

The face of the body 1 adjacent the entrance of the passage 3 carries a fixed part 12 of a rotary switch whose movable part 13, in facing relation thereto, has a center opening 14 of the same section as that of the driver 9. The driver 9 has such length that when the key is fully introduced into the barrel 2 (FIG. 1), the opening 14 is closed by the driver 9. A cover-plate 15, formed over onto the body 1, protects the switch 12–13 and includes an opening 16 for the insertion of the key.

In the position shown in FIG. 1, the driver 9 acts simultaneously on the barrel 2 and on the moving part 13 of the switch so that they are both driven in rotation. When the barrel reaches the "stop" position (FIG. 2) the pistons 4 and 5 are in aligned relation and as soon as the key starts to be extracted, these pistons cooperate and lock the barrel 2 with respect to the body 1. If the key is extracted partially until the driver 9 is fully disengaged from the cavity 10 while it continues to cooperate with the opening 14 (FIG. 2), it is possible to rotate the key without driving the barrel 2 but in driving the moving part 13 of the switch until a given position is reached in which the switch 12–13 closes certain circuits, whereas the barrel has remained in the "stop" position, that is to say the means for locking a part, such as a steering column, are operative. The key can then be fully extracted. The means for locking the steering column or other part of the vehicle may take any conventional form and are not, per se, a part of this invention and for this reason are illustrated only schematically as comprising a drive connector shown in chain line at 22 and a bolt 24.

Figure 5:
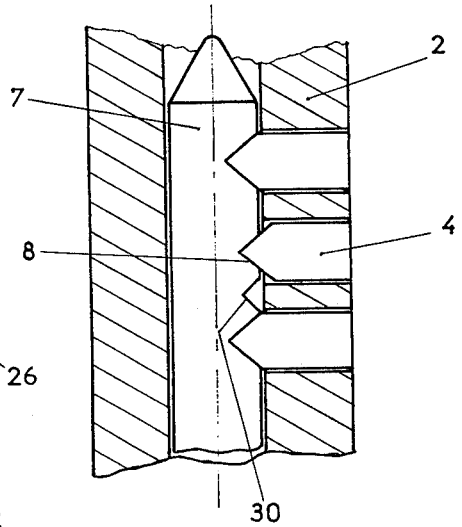
FIG. 5 is a detail of the embodiment of FIG. 1.

In order to reach the preceding axial position of the key, it is desirable that this position corresponds to a certain difficulty of extraction of the key so that the user does not accidentally pass therethrough and has no need to search for it. Thus, it is desirable to provide an axial abutment or an indexing device, for example as shown in FIG. 6 a spring-biased ball 26 which cooperates with a notch 28 in the key. In the embodiment of FIG. 5, a notch is provided in the key as at 30 and is so located that as the key is withdrawn from the passage of the barrel a tumbler element 4 will engage in that notch to indicate a position in which the drive is disengaged from the drive configuration of the barrel but is still engaged with the switch.

It will be observed that such an indexing can be provided by the shifting of the key through the distance between the notches, this shifting causing some of the pistons of the barrel to cooperate again with notches of the key; in this case the construction must be so arranged that the axial position of the key corresponding to the passage to the "parking" position correspond to such a shifting.

It is also desirable, after a partial extraction of the key, to ensure that it can be rotated only in a given direction leading to the "parking" position, for a rotation in the opposite direction would bring the switch 12–13 to positions which are different from the "parking" position. FIG. 3 shows an example of a simple arrangement to ensure this result. The body 7 of the key is provided with a radial pin 17 which cooperates with a radial recess 18 formed in the barrel 2 and axially opening out onto the key inserting end. This recess 18 has a diametral sectional shape in the form of an arc of a circle and terminates in two radial segments 19 and 20. The cooperation of the pin 17 with the segment 19 corresponds to the operation of the lock with the key fully inserted and the driver 9 engaged in the cavity 10 (position shown in FIG. 1). The pin 17 can only encounter the segment 20 (FIG. 3) when the key has been partially extracted. As the recess 18 is axially open, the key may be extracted in either position.

FIG. 4 shows a modification of the lock shown in FIGS. 1 and 2. In this embodiment, the key is provided with a driver 9 in the vicinity of the head 11, as before, and, moreover, with a second driver 21 in the vicinity of the front end or point of the key. The moving part 13 of the switch 12–13 is located in the vicinity of the inner end of the barrel and is driven by cooperation of the driver 21 with the opening 14. In this embodiment, the switch 12–13 may be the general switch of the anti-theft device having an additional "parking" position.

What is claimed is:

1. An anti-theft safety device for an automobile vehicle comprising a lock having a rotatable barrel cooperating with a key which has a cylindrical body and is provided with a driver of non-circular cross-sectional shape which cooperates with a cavity of complementary shape formed in the barrel, said barrel actuating, in the course of its rotation, means for locking at least one device essential for the operation of the vehicle and means for closing electric circuits, wherein there is provided a rotatable electric switch driven by cooperation of an opening of the switch with a driver, of complementary profile, on the key, the last-mentioned driver having sufficient length to continue to cooperate with said opening when the key has been partially extracted from the barrel and the driver for the barrel no longer drives the barrel.

2. An anti-theft device as claimed in claim 1, wherein the driver for the electric switch is constituted by an extension of the barrel driver and said switch is disposed between the barrel and the key entrance of the lock.

3. An anti-theft device as claimed in claim 1, wherein the driver for the switch is disposed in the vicinity of the free end of the key and said switch is disposed adjacent the end of the barrel opposite to the key entrance of the lock.

4. An anti-theft device as claimed in claim 3, wherein said switch is part of means for closing electric circuits of the anti-theft device.

5. An anti-theft device as claimed in claim 1, wherein means are provided for indexing the partial extraction of the key.

6. An anti-theft device as claimed in claim 5, wherein said indexing means comprise a spring-biased ball cooperating with a notch in the key.

7. An anti-theft device as claimed in claim 1, comprising means precluding rotation of the key in a given direction after its partial extraction.

8. An anti-theft device as claimed in claim 7, wherein said means precluding rotation of the key comprise a radial pin integral with the key and cooperating with a radial recess which has the shape of an arc of a circle in radial section and is formed in the barrel and axially opens onto the key entrance end of the barrel.

9. An anti-theft device for a vehicle comprising, in combination, a lock having a rotatable barrel comprising tumbler elements, a rotary electrical switch, and a key for insertion into said barrel, said key having a circular section for insertion into a correspondingly shaped key passage of said barrel, said stem being coded for cooperation with said tumbler elements so that upon inserting said stem fully into said passage, said barrel is freed for rotation, first drive means on said key cooperating with a drive configuration of said barrel when said key is fully inserted into said passage and being disengaged from said configuration upon partial withdrawal of said key, second drive means on said key cooperating with a drive configuration of a rotary operating element of said switch, said second drive means engaging said configuration of said switch element when said key is fully inserted into said passage and upon partial withdrawal of said key, whereby said switch element is drivable with said barrel when said key is fully inserted into said passage and is drivable while said barrel is locked when said key is partially withdrawn.

* * * * *